US012404093B2

(12) United States Patent
Fisher et al.

(10) Patent No.: US 12,404,093 B2
(45) Date of Patent: Sep. 2, 2025

(54) GATE OPENER FOR PROPPANT CONTAINER

(71) Applicant: PROPPANT EXPRESS SOLUTIONS, LLC, Denver, CO (US)

(72) Inventors: Marc Kevin Fisher, Castle Rock, CO (US); Brian Dorfman, Denver, CO (US); Kevin Gray, Midland, TX (US); Cory Snyder, Denver, CO (US); Matthew Oehler, Denver, CO (US); Mark John D'Agostino, Bozeman, MT (US)

(73) Assignee: Proppant Express Solutions, LLC, Denver, CO (US)

( * ) Notice: Subject to any disclaimer, the term of this patent is extended or adjusted under 35 U.S.C. 154(b) by 128 days.

(21) Appl. No.: 18/517,883

(22) Filed: Nov. 22, 2023

(65) Prior Publication Data

US 2024/0286829 A1 Aug. 29, 2024

Related U.S. Application Data

(60) Provisional application No. 63/486,823, filed on Feb. 24, 2023.

(51) Int. Cl.

| | |
|---|---|
| ***E21B 43/26*** | (2006.01) |
| ***B65D 88/30*** | (2006.01) |
| ***B65D 90/20*** | (2006.01) |
| ***B65D 90/48*** | (2006.01) |
| ***B65D 90/58*** | (2006.01) |
| ***B65D 90/66*** | (2006.01) |

(52) U.S. Cl.
CPC ..... *B65D 90/587* (2013.01); *B65D 88/30* (2013.01); *B65D 90/20* (2013.01); *B65D 90/48* (2013.01); *B65D 90/66* (2013.01); *E21B 43/2607* (2020.05); *B65D 2590/0083* (2013.01); *B65D 2590/668* (2013.01)

(58) Field of Classification Search
None
See application file for complete search history.

(56) References Cited

U.S. PATENT DOCUMENTS 3,085,517 A * 4/1963 Smith ..... B61D 7/20 406/122
4,301,741 A * 11/1981 Chierici ..... B65D 90/587 105/305
4,428,504 A * 1/1984 Bassett ..... B63B 27/22 105/247
4,946,068 A * 8/1990 Erickson ..... B01J 8/0015 222/23
5,261,333 A * 11/1993 Miller ..... B60P 1/56 105/308.1

(Continued)

*Primary Examiner* — Joseph A Dillon, Jr.
(74) *Attorney, Agent, or Firm* — Haynes and Boone, LLP; Randall C. Brown; Michael J. Tobin

(57) ABSTRACT

An automated gate actuator system is provided for use in selectively opening and closing a gate that dispenses proppant from a proppant container during the course of a hydraulic fracturing operation. A lever arm is pivotally mounted for movement to place a drive gear in contact with a driven gear to open and close the gate. The gate may be remotely or autonomously actuated in this manner utilizing an electronic control triggered by human and/or sensor input.

10 Claims, 8 Drawing Sheets

(56) References Cited

U.S. PATENT DOCUMENTS

| | | | | |
|---|---|---|---|---|
| 6,123,030 | A * | 9/2000 | Dohr | B61D 7/20 105/282.2 |
| 6,412,421 | B2 * | 7/2002 | Dohr | B61D 7/20 105/247 |
| 6,736,297 | B2 * | 5/2004 | Kassian | B65D 90/587 222/561 |
| 7,140,516 | B2 * | 11/2006 | Bothor | B65B 69/0075 222/173 |
| 7,475,796 | B2 * | 1/2009 | Garton | B65D 90/12 211/183 |
| 7,827,916 | B2 * | 11/2010 | Coots, Jr. | E01B 29/32 104/5 |
| 9,758,082 | B2 | 9/2017 | Eiden, III et al. | |
| 9,815,620 | B2 * | 11/2017 | Oren | B65D 88/542 |
| 10,118,529 | B2 * | 11/2018 | Eiden, III | B65D 88/32 |
| 10,654,667 | B2 * | 5/2020 | Orban | B65G 65/425 |
| 10,889,429 | B2 * | 1/2021 | Plazek | B60P 1/56 |
| 10,974,916 | B2 * | 4/2021 | Turle | B65G 65/463 |
| 11,292,677 | B2 * | 4/2022 | D'Agostino | B65G 15/30 |
| 12,286,290 | B2 * | 4/2025 | Lucas | B65D 88/1612 |
| 2003/0192452 | A1 * | 10/2003 | Lucas | B61D 7/20 105/247 |
| 2011/0011893 | A1 * | 1/2011 | Cerny | B65D 88/30 222/561 |
| 2014/0020765 | A1 * | 1/2014 | Oren | B65D 90/14 137/268 |
| 2016/0083177 | A9 * | 3/2016 | Oren | B65G 65/30 414/810 |
| 2016/0244279 | A1 * | 8/2016 | Oren | B65D 88/546 |
| 2021/0339966 | A1 * | 11/2021 | Lucas | B65G 65/40 |

* cited by examiner

GATE OPENER FOR PROPPANT CONTAINER

CROSS-REFERENCE TO RELATED APPLICATIONS

This application claims priority to U.S. Provisional Application No. 63/486,823 filed Feb. 24, 2023, entitled "Gate Opener For Proppant Container," the disclosure of which is hereby incorporated by reference in its entirety.

BACKGROUND

Field of the Invention

The presently disclosed instrumentalities pertain to the field of oilfield pumping equipment and, particularly, pumps used in support of well stimulation work such as hydraulic fracturing operations.

Description of the Related Art

Hydraulic fracturing is a well-known well stimulation technique in which pressurized liquid is utilized to fracture rock in a subterranean reservoir. In the usual case, this liquid is primarily water that contains sand or other proppants intended to hold open fractures which form during this process. The resulting "frac fluid" may sometimes benefit from the use of thickening agents, but these fluids are increasingly water-based. Originating in about the year 1947, use of fracturing technology has grown such that approximately 2.5 million hydraulic fracturing operations had been performed worldwide by 2012. The use of hydraulic fracturing is increasing. Massive hydraulic fracturing operations in shale reservoirs now routinely consume millions of pounds of sand. Hydraulic fracturing makes it possible to drill commercially viable oil and gas wells in formations that were previously understood to be commercially unviable. Other applications for hydraulic fracturing include injection wells, geothermal wells, and water wells.

U.S. Pat. No. 9,758,082 to Eiden et al. describes a significant advance in the art through use of sealed containers utilized to supply proppant for use in hydraulic fracturing operations. The containers are built to be moved by forklift for loading and unloading purposes and may be stacked at a wellsite location to densify the storage of sand. The containers thereof include a gate assembly formed as a sliding plate that selectively opens and closes a central discharge opening at the bottom of the container for the selective discharge of proppant from a reservoir within the container. This gate assembly, however, includes a manually operated screw-jack for opening and closing the gate to dispense proppant from the containers. This creates operational delays where, for example, the proppant containers may completely discharge their load of proppant onto a conveyor every few minutes, and someone is kept busy actuating the screw-jack.

SUMMARY

The instrumentalities disclosed herein overcome the problems outlined above and advance the art by providing an automated gate assembly that may be controlled remotely for dispensing proppant, such as sand, in support of hydraulic fracturing operations.

According to one embodiment, an automated gate actuator system includes a proppant container. The proppant container is made of a frame supporting a reservoir that is made to hold proppant. The reservoir is defined by a top, sidewall structure descending downwardly from the top, and a hopper descending downwardly from the sidewall structure and narrowing towards a centrally located discharge opening. A movable plate is operably located on tracks for selective shifting motion between a first position covering the central discharge opening and a second position that at least partially uncovers the central discharge opening for the selective release of proppant from the reservoir when proppant resides in the reservoir. The movable plate includes a gear track and a system of gears. The system of gears includes at least one cog positioned to engage the gear track for linear shifting motion of the plate between the first position and the second position. The system of gears also includes a driven gear such that the system of gears provides a mechanical pathway between the driven gear and the at least one cog.

A sled has a loading station built thereon for transiently retaining the proppant container. A lever arm is pivotally mounted to the sled, and has a drive gear together with a mechanism, such as a hydraulic, electric or pneumatic motor, mounted on the lever arm for driving the drive gear. A selectively extensible piston-cylinder is connected to the lever arm for movement thereof between a position of engagement where the drive gear is placed into engagement with the driven gear to actuate the linear shifting motion of the plate, and a position of disengagement where the drive gear is not touching the driven gear. Structure is provided on the sled for positioning the proppant container at the loading station with sufficient precision for the movement to occur. This structure may be, for example, that of an intermodal connector or a pocket having sloped sidewalls that act as a guide as the proppant container is being lowered onto the sled.

In one aspect, at least one of the drive gear and the driven gear are made of an elastomer. This is preferably the driven gear residing on the proppant container. The other of the drive gear and the driven gear may be made of metal.

In one aspect, the gear track may be formed as a plurality of slots cut through the plate.

An electronic control may also be provided. The electronic control may be user-selectable to produce the selective shifting motion of the plate by interaction of the systems of gears and the drive wheel of the lever arm. The electronic control may also be provided with a sensor, such as an optical sensor, to alert the user when proppant is not flowing from the proppant container. The control may also be an external signal from a blender or a hopper signaling that more or less sand is needed to maintain usable capacity, thereby triggering the actuator to make an adjustment in flowrate from one or more containers.

DETAILED DESCRIPTION

There will now be shown and described, by way of non-limiting examples, various instrumentalities for overcoming the problems discussed above.

Figure 1:
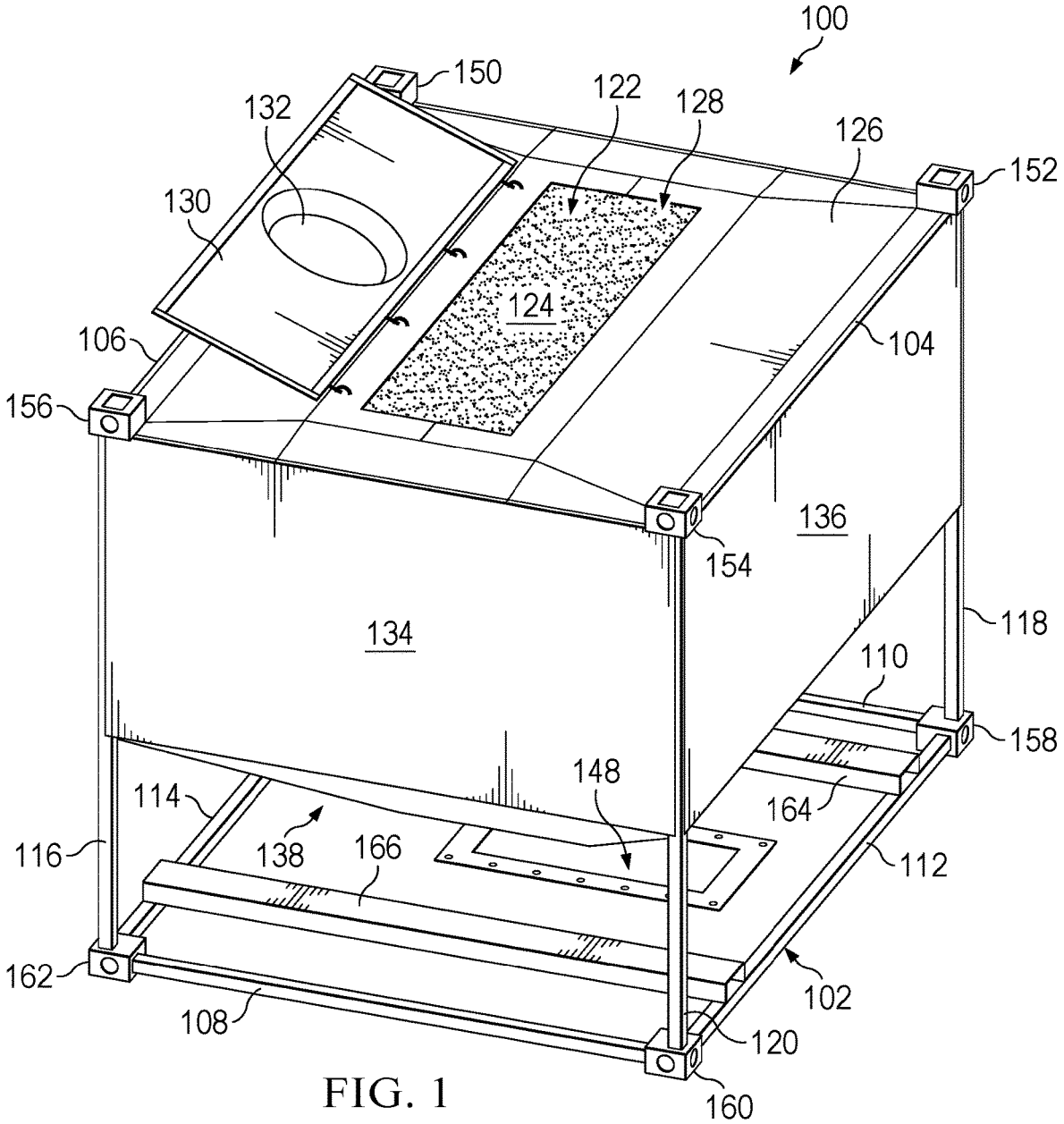
FIG. 1 is a left side perspective view of a proppant container that is equipped with a gate assembly according to the presently disclosed instrumentalities.
Figure 2:
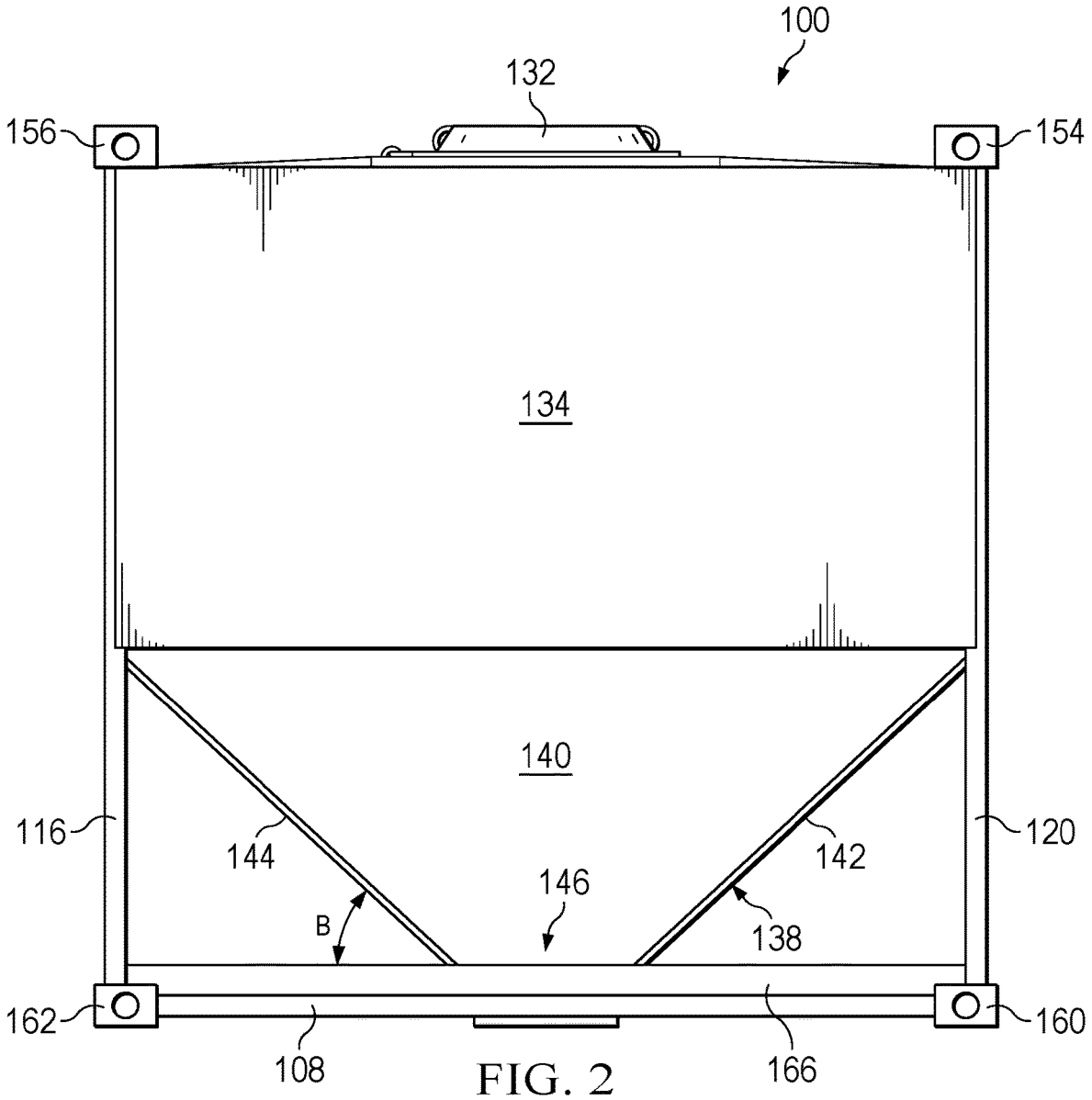
FIG. 2 is a left side elevation view thereof.
Figure 3:
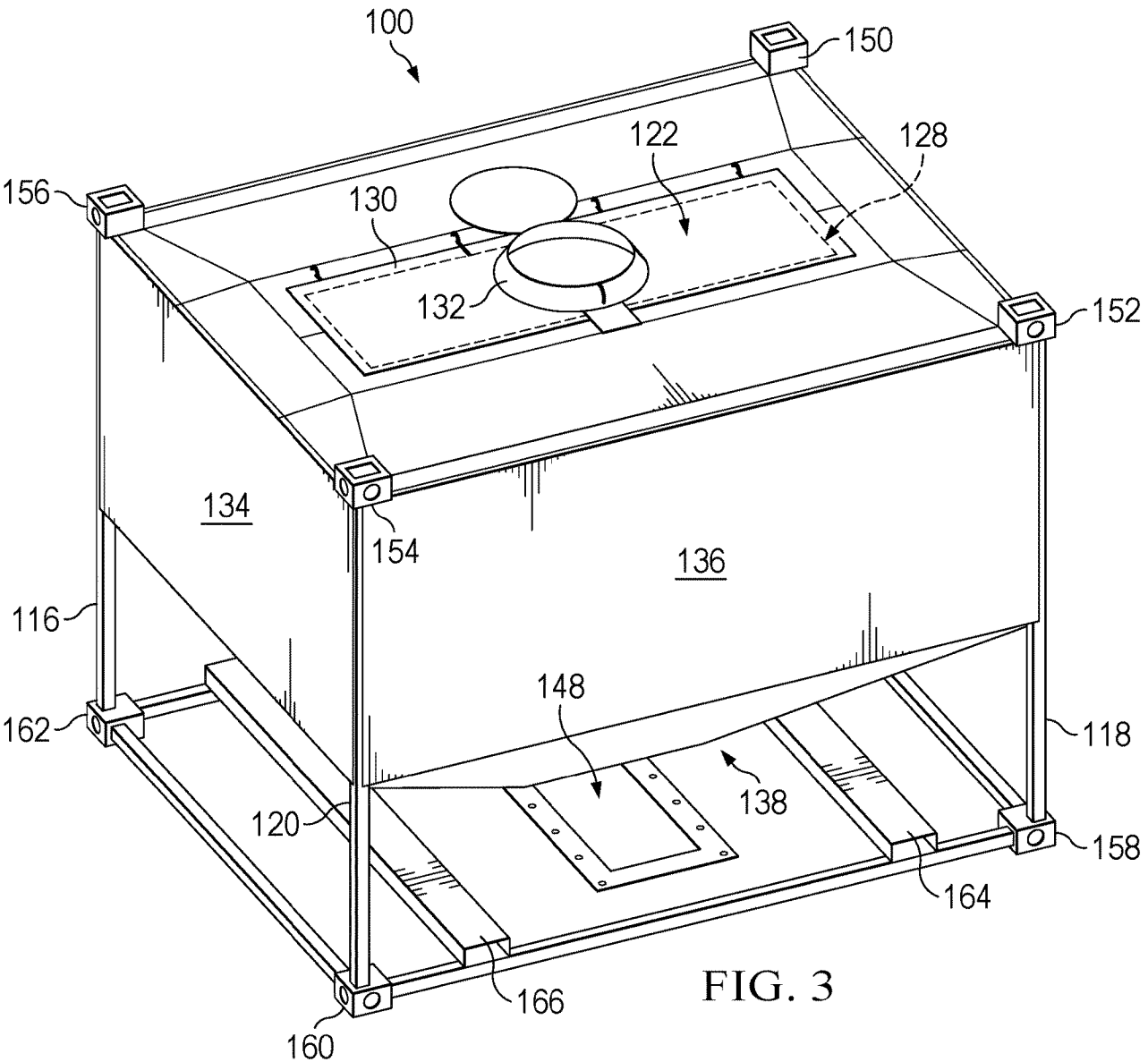
FIG. 3 is a left front perspective view thereof.

FIGS. 1-3 show a proppant container 100. A rectilinear frame 102 includes, for example, a plurality of horizontal braces 104, 106, 108, 110, 112, 114 together with upright posts 116, 118, 120. An internal reservoir 122 is provided to contain proppant, such as sand, for use in a hydraulic fracturing operation. The reservoir 122 is defined by a top 126 through which is formed an opening 128 that is optionally sealed by an egress hatch 130 into which is built a fill portal 132. Upright sidewalls 134, 136 descend downwardly from the top towards a hopper 138. It will be appreciated that the walls 134, 136 have opposite counterparts (not shown) that fully enclose the reservoir 122.

The hopper 138 has four walls, such as walls 140, 142, 144, that descend from the sidewalls 134, 136 and slope at an angle β towards a central discharge opening 146. The angle β is sufficient to facilitate the gravity flow of dry proppant within the reservoir 122 and suitably ranges from about 35° to 50°. A gate assembly 148 may be selectively opened and closed to dispense the proppant 124 from within the reservoir 122.

The proppant container 100 is preferably sized in conformity with standard dimensions for intermodal shipping containers and may be provided with intermodal connectors 150, 152, 154, 156, 158, 160, 162. Forklift tubes 164, 166 are used to move the proppant container 100 by methods known to the art.

Figure 4:
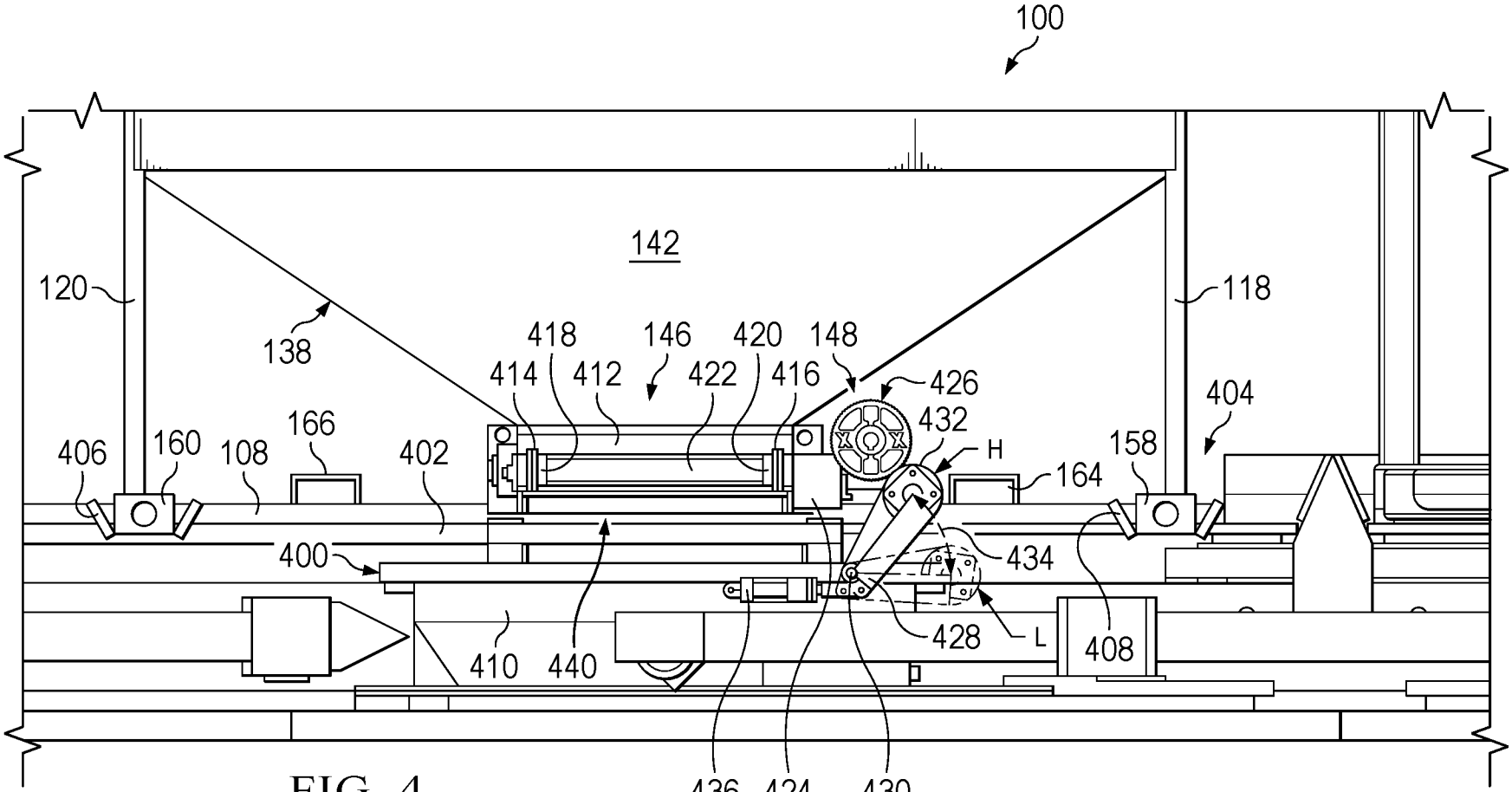
FIG. 4 shows the proppant container mounted on a conveyor sled that has a hydraulically actuated lever arm for inter-engaging with the gate assembly.

FIG. 4 provides additional detail with respect to the gate assembly 148. The proppant container 100 is shown residing atop a sled 400 having a top rail 402 with a loading station 404 being defined by inwardly sloped pockets 406, 408 of complementary dimensions for receipt of intermodal connectors 158, 160. The pockets 406, 408 may be provided with intermodal pins (not shown) to enhance the precision of placement of the proppant container 100 in the loading station 404. The hopper 138 is positioned to discharge proppant into a conveyor hopper 410 that, in turn, discharges the proppant onto a conveyor (not shown) as is known in the art. It will be appreciated that the sled 400 may be provided with any number of loading stations 404, each for receipt of a proppant container identical to proppant container 100.

The gate assembly 148 includes a steel 412 plate having slots (not shown) cut through the plate 412 forming parallel gear tracks 418, 420 for engaging with cogs 414, 416. The cogs 414, 416 are mounted on a common axle 422 that is driven by a gear box 424. The gear box 424 is driven by a geared or chain linkage which is actuated by a driven gear 426. A lever arm 428 is mounted to the sled 400 at pivot 430 to raise and lower a drive gear 432 along arc 434 between positions H and L under motive force provided by extensible cylinder 436 which may be, for example, a pneumatic, electric, or hydraulic cylinder. The drive gear 432 may be co-mounted on the lever arm 428 with a hydraulic motor (not shown). Thus, in the intended environment of use, the proppant container 100 is positioned at the loading station 404 with sufficient precision permitting the movement of lever arm 428 to engage the driven gear 426 at position H. The resultant movement of the driven gear 426 is translated through the gear box 424 to axle 422 and cogs 404, 416, which translate the plate 412 for selective opening and closing of the discharge opening 146.

Load cells may be placed at the pockets 404, 406 to sense when the proppant container 100 is empty. Alternatively, an optical sensor, such as a laser-photocell, may be positioned at a gap 440 to sense when proppant is being discharged by occlusion of the laser when the gate assembly 148 is open. An empty condition exists when the laser is not occluded while the gate assembly is open.

Figure 5:
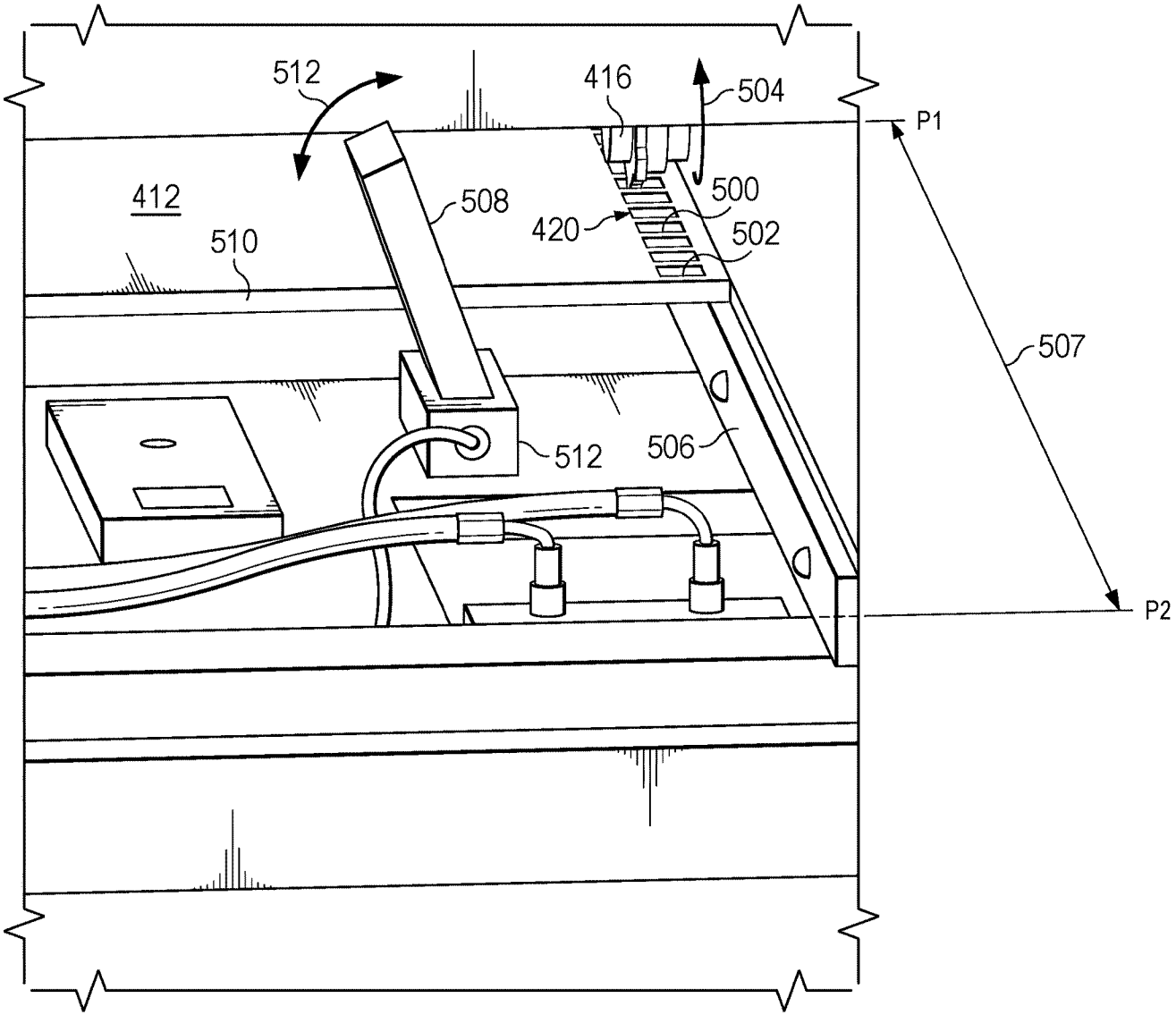
FIG. 5 is a front top perspective view providing additional detail with respect to operation of the gate assembly.

FIG. 5 provides additional detail with respect to the mechanism for translation of the plate 412. The plate 412 is provided with slots 500, 502 that are cut through the plate 412 forming gear track 420 for engagement with cog 416. Selective rotation 504 of the cog 416 shifts the plate 412 rearwardly along rail 506 to accomplish shifting motion 507 between a first position P1 covering the aforementioned discharge opening 146 (not shown in FIG. 5) and forwardly to a second position P2 uncovering the discharge opening. An optional toggle arm 508 is spring-biased towards edge 510 of the plate 412 and, consequently, travels in pivotal motion along arc 512 concomitant with the shifting motion 507 of the plate 412. The toggle arm is mounted in a box 512 that contains a switch circuit configured to sense the position of the plate 412 and provide electronic, electromagnetic or optical signals representative of the sensed position. The signals are networked to a controller (see, for example FIG. 8) that receives the signals and interprets the same to provide suitable control instructions to a primary mover (not shown) that is used to actuate the shifting motion 507 of the plate 412.

Figure 6:
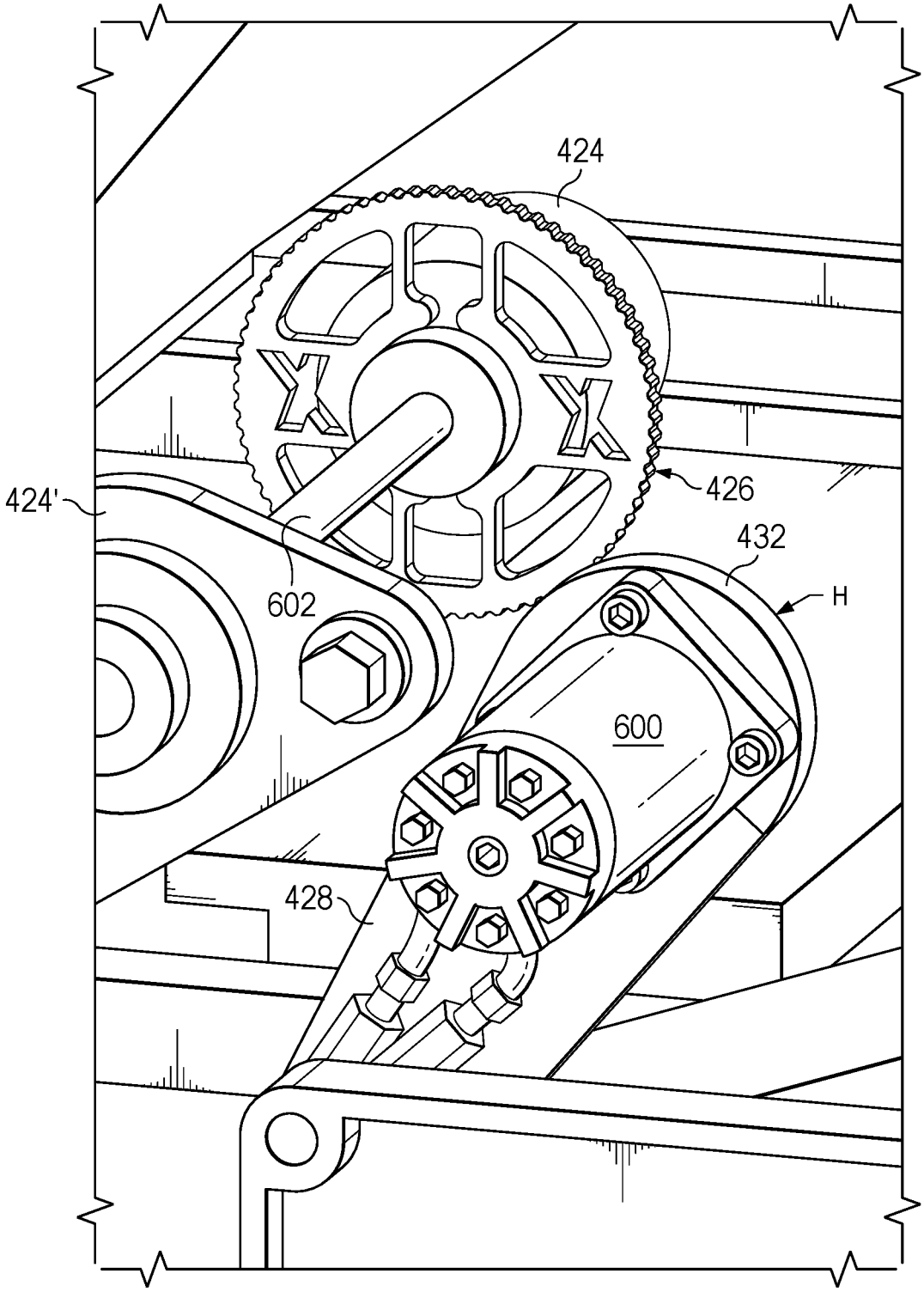
FIG. 6 provides additional detail with respect to inter-engagement of the lever arm and the gate assembly.

FIG. 6 shows the lever arm 428, upon which are co-mounted the drive gear 432 and a hydraulic motor 600, which may constitute the aforementioned prime mover according to one embodiment. The hydraulic motor 600 is remotely controlled for actuation of the drive gear 432. As shown in FIG. 6, the lever arm has been moved upwardly to position H where the drive gear 432 engages the driven gear 426. The driven gear 426 imparts motive force to respective gearboxes 424, 424' through shaft 602 for the rotation of cogs 414, 416 as described above. Where the gear track 420 shown in FIG. 5 is located at the right side of the plate 412, the gear track 418 (not shown in FIG. 5) is a mirror image thereof located on the left side of the plate 412.

Figure 7:
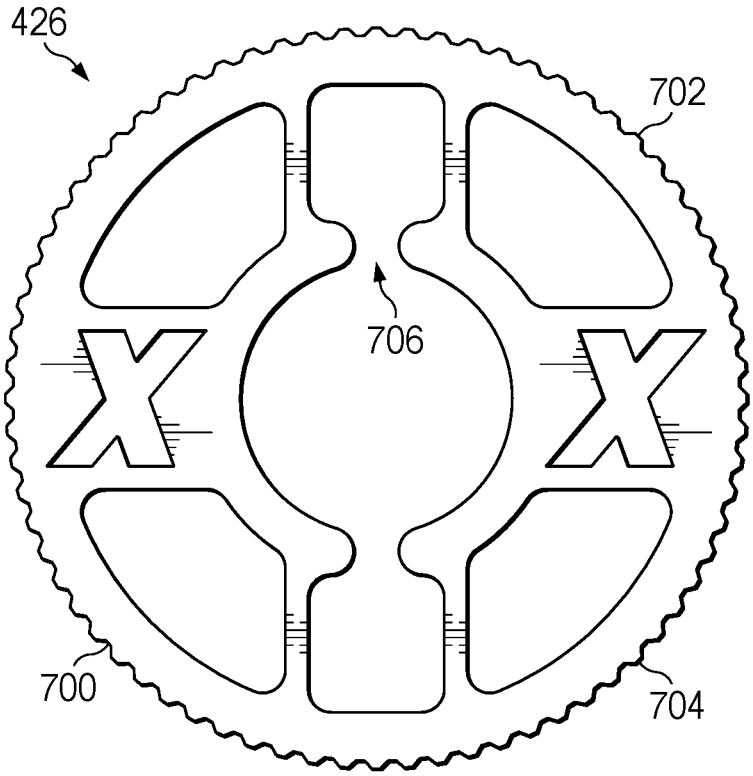
FIG. 7 shows a driven gear for use in the drive train of the gate assembly according to one embodiment.

In practice, it is difficult to achieve a perfect alignment between the drive gear 432 and the driven gear 426, primarily because the tolerances for the placement of the proppant container 100 in the loading station 404 exceed the tolerances for the alignment for inter-engagement between the drive gear 432 and the driven gear 426. Accordingly, in preferred embodiments, the driven gear 426 is made of an elastomer. This is shown in FIG. 7, which shows an elastomeric form of the driven gear 426 according to one embodiment. An outer periphery 700 has a plurality of raised deformable nibs 702, 704, which are made in the manner of gear teeth. A double bell-ended opening 706 is formed at the center of the driven gear 426 and is sized to receive a correspondingly belled torsion bar (not shown) facilitating the transfer of torque to the gearboxes 424, 424' through the shaft 602 (see FIG. 6). The deformable nature of the nibs 702, 704 compensates for small misalignments between the drive gear 432 and the driven gear 426. Because the material of the driven gear 426 is softer and, consequently, will incur greater wear, it is preferred that the driven gear 426 residing on the gate assembly 146 of the proppant container 100 be made of elastomeric material, with the drive gear 432 being made of metal. However, both the drive gear 432 and the driven gear 426 may be made of metal or elastomer.

Figure 8:
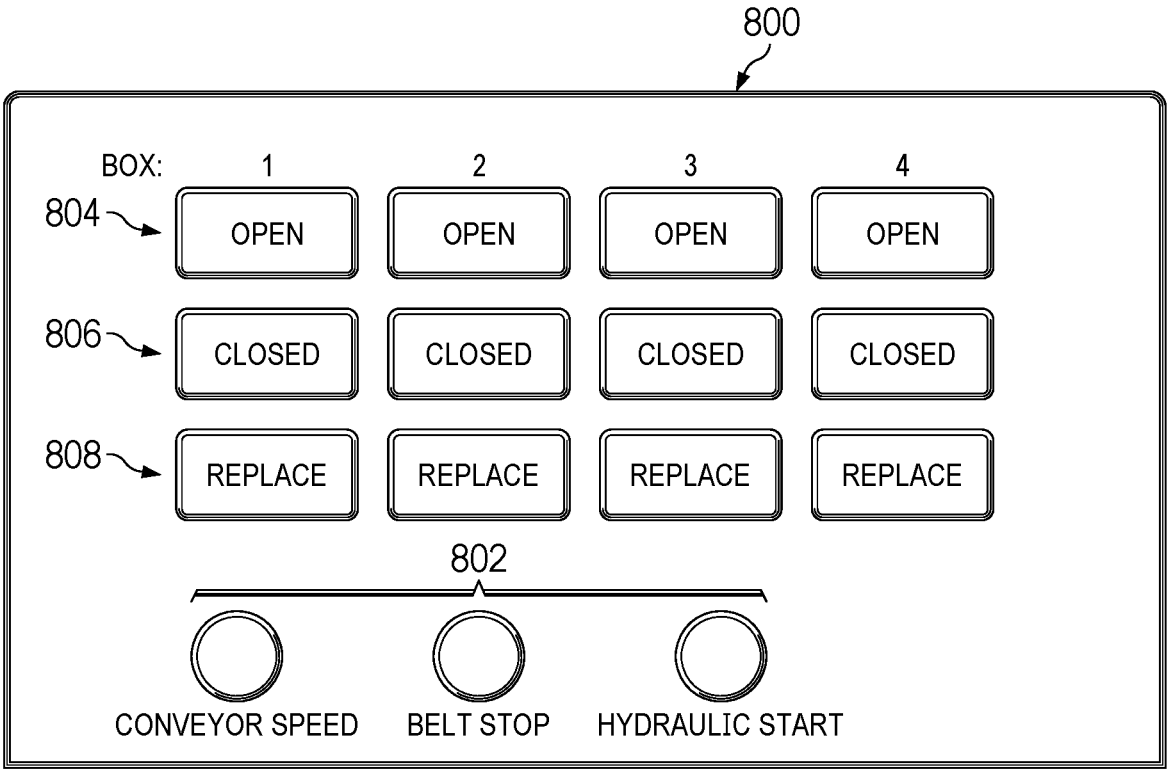
FIG. 8 shows a control panel for remote operation of the automated gate actuator system.

FIG. 8 shows a control panel 800 providing a graphical user interface for remote operation of the gate assembly 148 as described above. The control panel 800 may be, for example, a touch screen. Buttons 802 may be touched to initiate control of various components on sled 400, such as speed of the conveyor belt, emergency stop of the conveyor belt, and startup of the hydraulic system. As shown in FIG. 8, the control panel controls a total of four of the proppant containers 100, each of which are mounted at different loading stations 404 on a common sled 400. A user, which may be for example a sand controller in charge of a hydraulic fracturing operation, may touch individual boxes in rows 804 or 806 for selective control to open or close the gate assemblies 148 on each of the proppant containers 100. Each of the boxes then retains a color-coded status indicator, such as green for open and yellow for closed. Row 808 is optional and flashes a third color, orange for example, when sensors mounted at the respective loading stations 404 sense that there is no discharge of proppant when the corresponding one of the proppant containers 100 is empty.

Those of ordinary skill in the art will understand that the foregoing discussion teaches by way of example and not by limitation. Accordingly, what is shown and described may be subjected to insubstantial change without departing from the scope and spirit of invention. The inventors hereby state their intention to rely upon the Doctrine of Equivalents, if needed, in protecting their full rights in the invention.

We claim:

1. An automated gate actuator system comprising:

a proppant container having a frame supporting a reservoir made to hold proppant the reservoir being defined by a top, sidewall structure descending downwardly from the top, a hopper descending downwardly from the sidewall structure and narrowing towards a centrally located discharge opening, a movable plate operably located for selective shifting motion between a first position covering the central discharge opening and a second position that at least partially uncovers the central discharge opening for the selective release of proppant from the reservoir when proppant resides in the reservoir, the movable plate including a gear track, and a system of gears including at least one cog positioned to engage the gear track for linear shifting motion of the plate between the first position and the second position, and a driven gear, the system of gears providing a mechanical pathway between the driven gear and the at least one cog;

a sled having a loading station built thereon for transiently retaining the proppant container, the sled having a lever arm pivotally mounted to the sled, the lever arm having a drive gear and means mounted on the lever arm for driving the drive gear, and a selectively extensible piston-cylinder operably connected to the lever arm for movement thereof between a position of engagement where the drive gear is be placed into engagement with the driven gear to actuate the linear shifting motion of the plate, and a position of disengagement where the drive gear is not touching the driven gear; and means for positioning the proppant container at the loading station with sufficient precision for the movement to occur.

2. The automated gate actuator system of claim 1, wherein at least one of the drive gear and the driven gear are made of an elastomer.

3. The automated gate actuator system of claim 1, wherein the driven gear is made of the elastomer and the driven gear is made of metal.

4. The automated gate actuator system of claim 1, wherein the means for positioning includes an intermodal connector.

5. The automated gate actuator system of claim 1, wherein the means for positioning includes a pocket with sloping sidewalls.

6. The automated gate actuator system of claim 1, wherein the means mounted on the lever arm includes at least one element selected from the group consisting of a hydraulic motor, an electric motor and a pneumatic motor.

7. The automated gate actuator system of claim 1, wherein the gear track is formed as a plurality of slots cut through the plate.

8. The automated gate actuator system of claim 1, further comprising an electronic control that is user-selectable for the selective shifting motion.

9. The automated gate actuator system of claim 1, further comprising a sensor mounted to sense a position of the movable plate and to provide signals representative of the position, an electronic control configured to receive the signal and interpret the signal to provide control instructions to the means mounted on the lever arm for automated shifting of the movable plate according to the selective shifting motion.

10. The automated gate actuator system of claim 1, further comprising a sensor that is mounted on the sled and configured to detect when proppant is flowing from the reservoir.

* * * * *